United States Patent [19]

Ford et al.

[11] Patent Number: 4,995,593

[45] Date of Patent: Feb. 26, 1991

[54] CRUCIBLE HAVING A MOVABLE DROSS COLLECTOR COMPRISING AN INDUCTION COIL

[75] Inventors: David A. Ford, Bristol; Gordon J. S. Higginbotham, Derby; David R. Pugh, Bristol; Naresh Kumar, Birmingham, all of England

[73] Assignee: Rolls-Royce plc, England

[21] Appl. No.: 453,999

[22] Filed: Dec. 20, 1989

[30] Foreign Application Priority Data

Dec. 20, 1988 [GB] United Kingdom ..... 8829689.2

[51] Int. Cl.[5] ..... F27D 11/06

[52] U.S. Cl. ..... 266/227; 266/234; 373/143

[58] Field of Search ..... 266/227, 234, 237, 240; 373/142, 143

[56] References Cited

U.S. PATENT DOCUMENTS 3,297,311 1/1967 Stenkvist et al. ..... 266/237

FOREIGN PATENT DOCUMENTS 806256 2/1981 U.S.S.R. ..... 266/227

*Primary Examiner*—Melvyn J. Andrews

*Attorney, Agent, or Firm*—Oliff & Berridge

[57] ABSTRACT

Apparatus for pouring molten metal comprises a cold crucible 15 which has a recess adjacent its top and a pouring spout 16 positioned in the recess just below the level of the surface of the melt. The recess defines a lip above the spout which helps to ensure that there is a constant pressure head above the spout. Pivotally mounted on the lip, and biased to assume a horizontal position irrespective of the angle of tilt of the crucible is an induction coil 21. The coil induces currents in the surface of the melt and thereby moves the dross away from the pouring spout. The crucible 15 pours into a constant head hopper 22 and the opening and closing of the crucible pouring spout 16 and the angle of tilt of the crucible are controlled to ensure constant pressure head in the hopper.

8 Claims, 1 Drawing Sheet

CRUCIBLE HAVING A MOVABLE DROSS COLLECTOR COMPRISING AN INDUCTION COIL

This invention relates to the casting of pure metal components.

There is a need when casting metal components to be able to pour pure metal; that is to say metals which do not contain any impurities, slag, or dross from the melt.

An object of the present invention is to provide an effective means of separating dross and other impurities from a melt.

According to the invention there is provided collector means for collecting dross on the surface of a melt in a crucible which has a pouring lip, spout or the like, comprising an electromagnetic induction coil located above the surface of the melt which is shaped and positioned relative to the crucible to generate eddy currents which move the dross away from the pouring lip, spout or the like.

Figure 1:
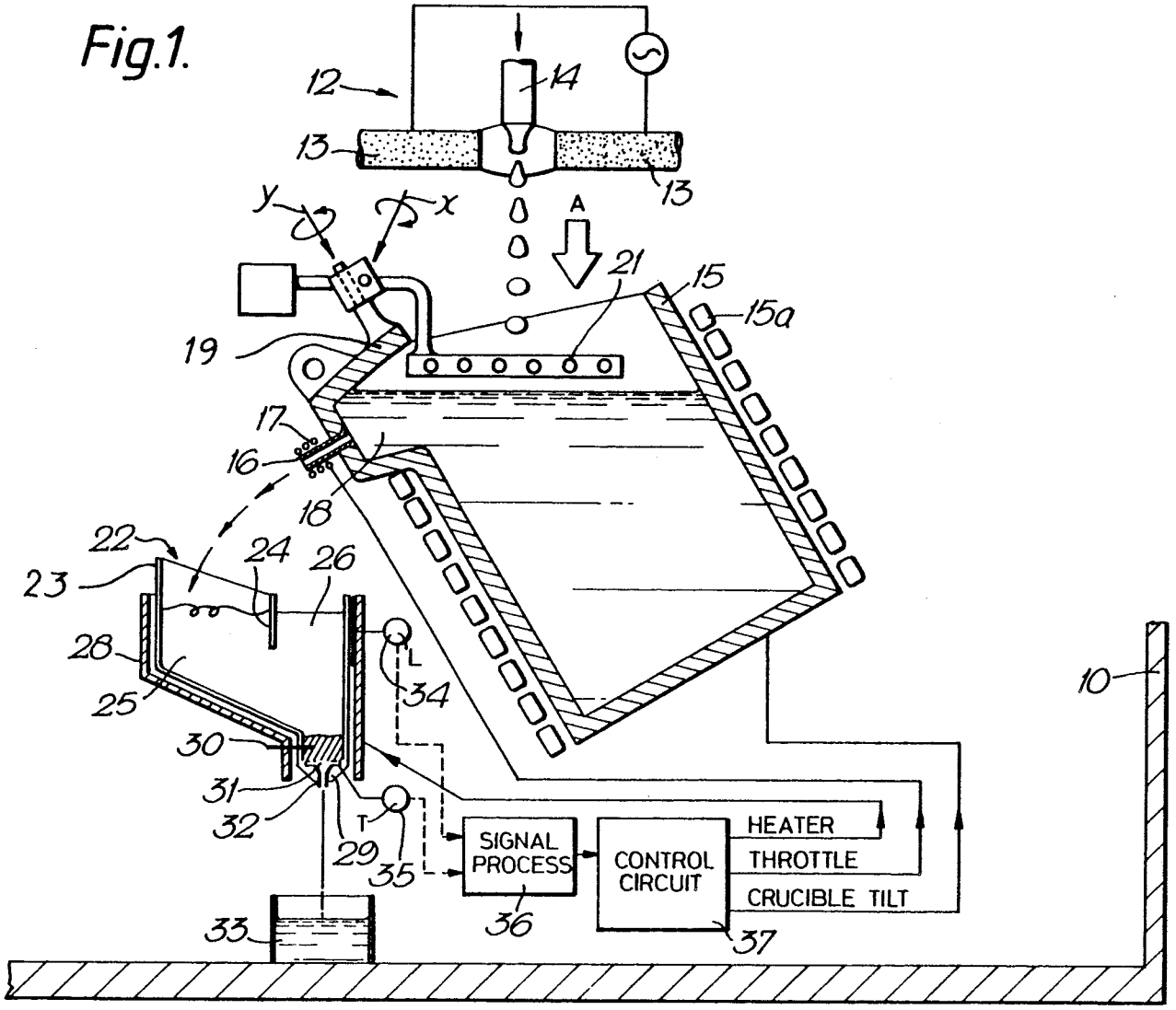
Figure 2:
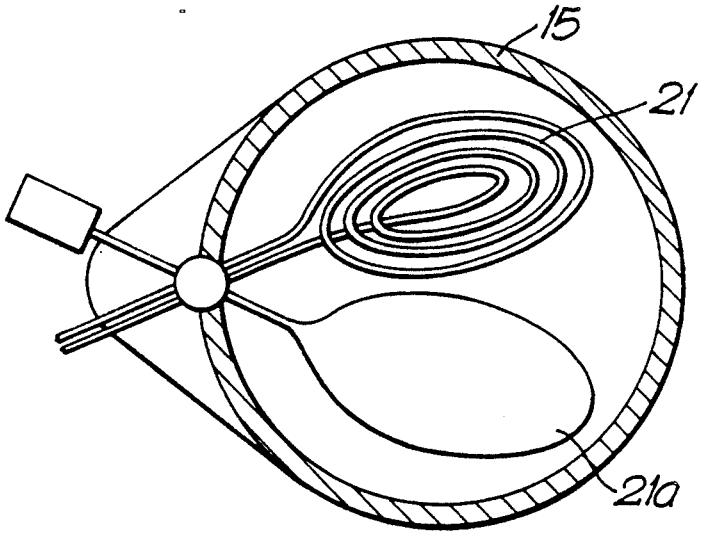

An embodiment of the present invention will now be described, by way of an example, with reference to the accompanying drawing in which:

FIG. 1 shows a cold crucible melting apparatus incorporating a dross collector of the invention, and FIG. 2 is a view in the direction of arrow "A" in FIG. 1 of a dross collector having a separate chill.

FIG. 1 shows a clean melting furnace. At 10 there is shown part of a wall of a vacuum furnace including an hermetically sealed chamber in which is located an arc melting furnace generally indicated at 12 comprising a pair of electrodes 13 between which an electrical arc is struck. A rod 14 made of the metal to be cast is advanced slowly through the arc and thereby melted.

The molten metal is collected in a recepticle of the type known as a cold crucible 15 in which there is minimum contact between the melt and the crucible walls in order to avoid contamination of the melt by contact. Alternatively a water cooled copper crucible 15 may be used. The crucible or rather its contents is also heated by an induction heater 15a to maintain a desired metal temperature. Dross, that is contaminants, slag and such like, tends to rise to the surface. An inert gas such as argon may be bubbled into the bottom of the crucible to assist in this natural separation process.

The crucible 15 is pivotally mounted in the chamber so as to enable molten metal to be poured through a spout 16. The spout 16 is made of ceramic material and is located in a recessed region 18 formed, towards the rim of the crucible and in one side thereof, by a lower outward projection of the crucible wall and an upper re-entrant lip 19. The region 18 and the lip 19 ensure that the spout 16 is always located just below the surface of the melt. Also it ensures that the pressure head of the melt as it is poured is substantially constant over substantially the whole range of angles of tilt.

Essentially the recessed region has the form and effect of a funnel which acts to accumulate over the pouring spout a resevoir of molten metal drawn from under the surface of the melt. The sides of this funnel region taper towards the spout 16, i.e. the underside of the lip 19 and its corresponding opposite wall at least, in order to maintain a substantially constant head above the pouring spout 16 when the crucible is progressively tilted during pouring. The advantage of the region is most marked towards the end of a pouring operation when the crucible is almost empty; under these conditions it is difficult to maintain an adequate flow rate from a conventionally shaped crucible, but with a crucible in accordance with the present invention the reservoir in the region 18 maintains a sufficient head of molten metal.

An electromagnetic throttling means 17 is provided for controlling the flow of metal through spout 16 comprising a coil wound around the spout and connected to electrical energising means to be described below. The coil 17 is energised to control the flow of molten metal through the spout by electromagnetic reaction. The effect of the throttle depends on the flow rate of the metal through spout 16 and therefore on the tilt angle of the crucible. If fully energised it can act to stem the flow of molten metal. Normally the energising current to coil 17 is varied to control the pouring rate from spout 16 at a predetermined rate, the pouring rate is inferred from the output of a level indicator in a receiving tundish, see below.

Pivotally mounted towards the margin of the lip 19 is a second electrical induction coil 21. The coil 21 is spirally wound in a common plane and may either be counter balanced about its pivotal attachment to the lip 19, or otherwise is held in a horizontal position, so that when molten metal is poured, irrespective of the angle of tilt of the crucible the coil 21 remains substantially horizontal just above the surface of the molten metal. When the coil 21 is electrically energised eddy currents are induced in the surface of the melt and these cause an dross that forms on the surface of the melt to be moved and held away from the pouring spout. The coil 21 does not need to cover the whole surface area of the melt but may be confined to a smaller area.

Preferably the coil 21 is pivotally mounted for movement about two orthogonal axes x,y, one horizontal and the other vertical. The horizontal pivot axis x allows the coil 21 to be raised and lowered over the melt. The vertical axis y permits the coil to be swept across the face of the melt. When it is desired to remove dross from the surface of the melt the coil is lowered towards, but not into contact with the, surface and swept across the surface away from the vicinity of the pouring lip or spout. The induction coil 21 may also form a chill which can be lowered into the collected dross to freeze it prior to removal. Using the chill solidified dross can be lifted away from the surface of the melt. One form of chill would comprise a disposable hollow tubular electrode through which a coolant flows. The electrode is wound into a planar spiral to form the induction coil 21 into a "pancake" shaped coil.

In an alternative embodiment of the invention, a separate chill, cooled if desired, is then lowered into the accumulated dross to cause it to solidify on the chill. The frozen dross is then lifted out of the melt adhering to the chill. Preferably the chill is disposable with the frozen dross attached, economically it is almost certainly not feasible to attempt a cleaning operation. The integral induction coil and chill of FIG. 1 may also be disposable for the same reasons of economy.

Located in the path of the metal poured from the spout of the crucible 15, is a fixed constant pressure head feeding hopper 22. The hopper 22 comprises a cooled metal container 23, which has a dividing wall 24 to divide the top of the hopper into a receiving section 25 and a "quiet" zone 26. The melt received in the hopper 22 is maintained molten by means of an induction heater 28. The bottom of the hopper tapers towards a lower outlet 29 which incorporates a porous ceramic filter 30, a solid metal blanking piece 31 and changeable nozzle 32. The blanking piece 31 effectively blocks the outlet until it melts and then allows the melt to flow into a mould cavity or other receptacle 33.

A level sensor 34 is provided towards the top of the hopper 22 and a temperature sensor 35 is provided at the outlet. The signals from these sensors 34, 35 are fed via a signal processing 36 circuit to a control circuit 37 which controls the switching on and off of the heating coils 15*a* and 28, the opening and closing of the electromagnetic throttle 17, and the tilting of the crucible 15 in order to ensure that a substantially constant pressure head or melt level is maintained in the hopper 22. The crucible tilt angle is controlled to follow a predetermined program designed to obtain the required pouring rate.

The temperature of the molten metal collected in crucible 15 is controlled and stabilised by energising of the induction heater 15*a* and this serves to ensure that the dross settles out on the top of the melt well above the pouring spout 16. The coil 21 ensures that the dross is moved away from the region of the spout 16.

It is to be understood that other forms of heating could be employed instead of arc melting described above, for example, electron beams or plasma melting techniques.

We claim:

1. A combined crucible and dross collector comprising a crucible having one side of a top thereof pouring means and movable dross collector, said dross collector comprising an electromagnetic induction coil means located near the top of the crucible and mounted for movement relative to the crucible at least in a lateral sweeping movement.

2. A combined crucible and dross collector as claimed in claim 1 wherein the coil is mounted for pivotal movement about a vertical axis.

3. A combined crucible and dross collector as claimed in claim 1 wherein the coil is mounted to be selectively raised and lowered relative to the top of the crucible.

4. A combined crucible and dross collector according to claim 1 further comprising a chill, said chill comprising a cooled planar member movable relative to the crucible and being capable of being raised and lower relative to the top of the crucible.

5. A combined crucible and dross collector as claimed in claim 4, wherein the chill is formed integrally with the movable induction coil.

6. A combined crucible and dross collector according to claim 5, wherein the cooled planar member of the chill and said induction coil comprise a hollow tube, through which in use there is passed a cooling medium to cool the coil so that it acts as a chill.

7. A combined crucible and dross collector according to claim 4, further comprising a separate chill.

8. A combined crucible and dross collector as claimed in claim 6, wherein the chill is mounted for pivotal movement about a vertical axis.

* * * * *